US006008592A

United States Patent [19]

Ribarich

[11] Patent Number: 6,008,592

[45] Date of Patent: Dec. 28, 1999

[54] END OF LAMP LIFE OR FALSE LAMP DETECTION CIRCUIT FOR AN ELECTRONIC BALLAST

[75] Inventor: Thomas J. Ribarich, Laguna Beach, Calif.

[73] Assignee: International Rectifier Corporation, El Segundo, Calif.

[21] Appl. No.: 09/095,063

[22] Filed: Jun. 10, 1998

[51] Int. Cl.[6] ..... H05B 37/02

[52] U.S. Cl. ..... 315/225; 315/225; 315/307

[58] Field of Search ..... 315/225, 224, 315/307, DIG. 4, 291, 194, 195

[56] References Cited

U.S. PATENT DOCUMENTS

| | | | |
|---|---|---|---|
| 5,331,253 | 7/1994 | Counts | 315/209 R |
| 5,424,611 | 6/1995 | Moriarty, Jr. | 315/94 |
| 5,471,119 | 11/1995 | Ranganath et al. | 315/307 |
| 5,491,387 | 2/1996 | Saito | 315/307 |
| 5,525,872 | 6/1996 | Achten et al. | 315/291 |
| 5,539,281 | 7/1996 | Shackle et al. | 315/224 |
| 5,545,955 | 8/1996 | Wood | 315/224 |
| 5,717,295 | 2/1998 | Nerone | 315/307 |
| 5,719,472 | 2/1998 | Kachmarik et al. | 315/224 |
| 5,729,096 | 3/1998 | Liu et al. | 315/225 |
| 5,770,925 | 6/1998 | Konopka et al. | 315/225 |
| 5,818,669 | 10/1998 | Mader | 361/18 |

FOREIGN PATENT DOCUMENTS

| | | |
|---|---|---|
| 62-249398 | 10/1987 | Japan . |
| 242396 | 3/1990 | Japan . |
| 2199797 | 8/1990 | Japan . |
| 2148595 | 12/1990 | Japan . |
| 349187 | 3/1991 | Japan . |
| 3156892 | 7/1991 | Japan . |
| 3169265 | 7/1991 | Japan . |
| 473893 | 3/1992 | Japan . |

*Primary Examiner*—Don Wong
*Assistant Examiner*—Wilson Lee
*Attorney, Agent, or Firm*—Ostrolenk, Faber, Gerb & Soffen, LLP

[57] ABSTRACT

A circuit which detects an end-of-lamp life or false lamp condition in a fluorescent lamp being driven by an electronic ballast by indirectly sensing total load power through an analog signal indicative of the operating frequency while controlling lamp power using phase control, and which deactivates the half-bridge driver circuit if the operating frequency exceeds a predetermined maximum frequency. Controlling the lamp power via phase control enables the simple detection of excessive lamp power due to either a symmetrical or an asymmetrical increase in lamp running voltage over the course of the life of the lamp. A simple resistor user-programmable interface which allows flexibility for setting different threshold levels for different ballast/lamp combinations. The circuit is easily implemented in an electronic ballast driver IC (e.g., the IR2158/2159), resulting in the elimination of existing high-voltage-sensing-component methods, reduction of PCB interconnects, and an increase in manufacturability.

12 Claims, 14 Drawing Sheets

END OF LAMP LIFE OR FALSE LAMP DETECTION CIRCUIT FOR AN ELECTRONIC BALLAST

BACKGROUND OF THE INVENTION

1. Field of the Invention

The present invention relates to an electronic ballast circuit and, more specifically, to a circuit for detecting an end-of-life or false lamp condition for a fluorescent lamp driven by electronic ballast.

2. Description of the Related Art

When a fluorescent lamp is driven at high-frequency with an electric ballast, it is desirable to detect an end-of-life (EOL) lamp fault condition, or the operation of a lamp which is different from that which the ballast is designed for (i.e., a "false lamp"), and to shut the ballast off upon the occurrence of either event.

As a lamp approaches end-of-life, the voltage drop over one or both lamp filaments gradually increases, causing the total lamp voltage to increase symmetrically or asymmetrically. Similarly, if a false lamp is driven, the lamp voltage can exceed that which the ballast output stage is designed for. In either case, the increase in lamp voltage can cause the power being drawn by the lamp filaments to increase, depending on the type of output stage configuration connected to the lamp. If the filament power exceeds the maximum power for which the lamp is designed (i.e., the maximum power in the manufacturer's specifications), the heat being dissipated by the filament(s) can melt the tube glass, resulting in the fluorescent lamp falling out of the fixture and causing an injury.

FIG. 1 shows a typical ballast output stage that consists of a half-bridge driver circuit driving a totem-pole MOSFET or IGBT configuration at a given frequency. The square-wave voltage produced by the half-bridge switches drives a series-parallel lamp resonant circuit and therefore establishes the operating point for the lamp. The square wave voltage can be adjusted by changing the operating frequency and/or the DC bus voltage. Should the lamp voltage increase due to an end-of-life condition, the filament current, or capacitor $C_R$ current, also increases and is given by:

$$I_{Filament}=C_R \cdot V_{LAMP} \cdot f_{run} \quad [1]$$

where:

$C_R$=the capacitance of the resonant capacitor [in Farads];

$V_{LAMP}$=the running lamp voltage amplitude [in Volts]; and $f_{run}$=the running frequency [in Hertz].

Equation [1] shows that, for an increase in lamp voltage, there is a corresponding increase in the filament current. The filament power is then given by:

$$P_{Filament}=(I_{Filament})^2(R_{Filament}) \quad [2]$$

Equation [2] shows the power in the lamp filaments increasing quadratically with filament current. Equation [2] can also be written as:

$$P_{Filament} = \frac{V_{LAMP}^2}{R_{Filament}} \quad [3]$$

which shows the filament power increasing quadratically with lamp voltage.

FIG. 2 shows a timing diagram for typical running voltages and currents corresponding to the ballast output stage for both normal and end-of-life (symmetrical and asymmetrical) operating conditions. The timing diagram of FIG. 2*a* shows an increase in filament current ($I_{CR}$) during a symmetrical or asymmetrical increase in lamp voltage ($V_{LAMP}$) during end-of-life. It is this increase in lamp voltage as the lamp ages which causes excessive power to be dissipated in the filaments (equation [3]).

FIG. 3 shows a typical prior art circuit for detecting both symmetrical and asymmetrical peak lamp voltage. If the lamp voltage increases to between approximately 30 and 50 volts above the nominal, the resulting signal $V_{EOL}$ can be compared against a threshold, for example, and the ballast shut down when the threshold is exceeded. However, it is difficult and expensive to monitor the voltage out at the lamp and then regulate the operation of the electronic ballast driver circuit based on that voltage.

Furthermore, because of possible asymmetry of the lamp voltage, present circuit solutions may include one or more capacitors to block any dc offset, rectifiers and filters for establishing a low-voltage signal representative of the lamp voltage, and high-voltage resistive dividers for sensing. Care must also be taken to ensure that other operating points of the ballast, such as start-up, pre-heat and ignition, do not conflict with the end-of-life circuit, therefore requiring additional circuitry.

SUMMARY OF THE INVENTION

The present invention overcomes the deficiencies of the prior art noted above by providing a detection circuit which regulates the total load power (lamp+filaments). The circuit of the present invention advantageously operates to maintain the load power constant as the lamp ages, causing some other low-voltage control signal to change instead. This low-voltage control signal representative of the power being dissipated in the load is much easier and cheaper to monitor than the actual filament power at the load.

More specifically, the circuit of the present invention indirectly senses total load power through an analog signal indicative of the operating frequency while controlling lamp power using phase control, and deactivates the half-bridge driver circuit should the operating frequency exceed a predetermined maximum frequency. Controlling the lamp power via phase control enables the simple detection of excessive lamp power due to either a symmetrical or an asymmetrical increase in lamp running voltage over the course of the life of the lamp. The circuit of the present invention is also insensitive to the configuration of the ballast output stage around the lamp.

The preferred embodiment of the invention includes a simple resistor user-programmable interface which allows flexibility for setting different threshold levels for different ballast/lamp combinations. The circuit is easily implemented in an electronic ballast driver IC (e.g., the IR2158/2159), resulting in the elimination of existing high-voltage-sensing-component methods, reduction of PCB interconnects, and an increase in manufacturability.

The circuit of the present invention can advantageously be used to detect excess power to any load connected to a resonant circuit, and to deactivate the power to the load in the event of an excess power condition.

Other features and advantages of the present invention will become apparent from the following description of the invention which refers to the accompanying drawings.

DETAILED DESCRIPTION OF THE PREFERRED EMBODIMENT

Figure 1:
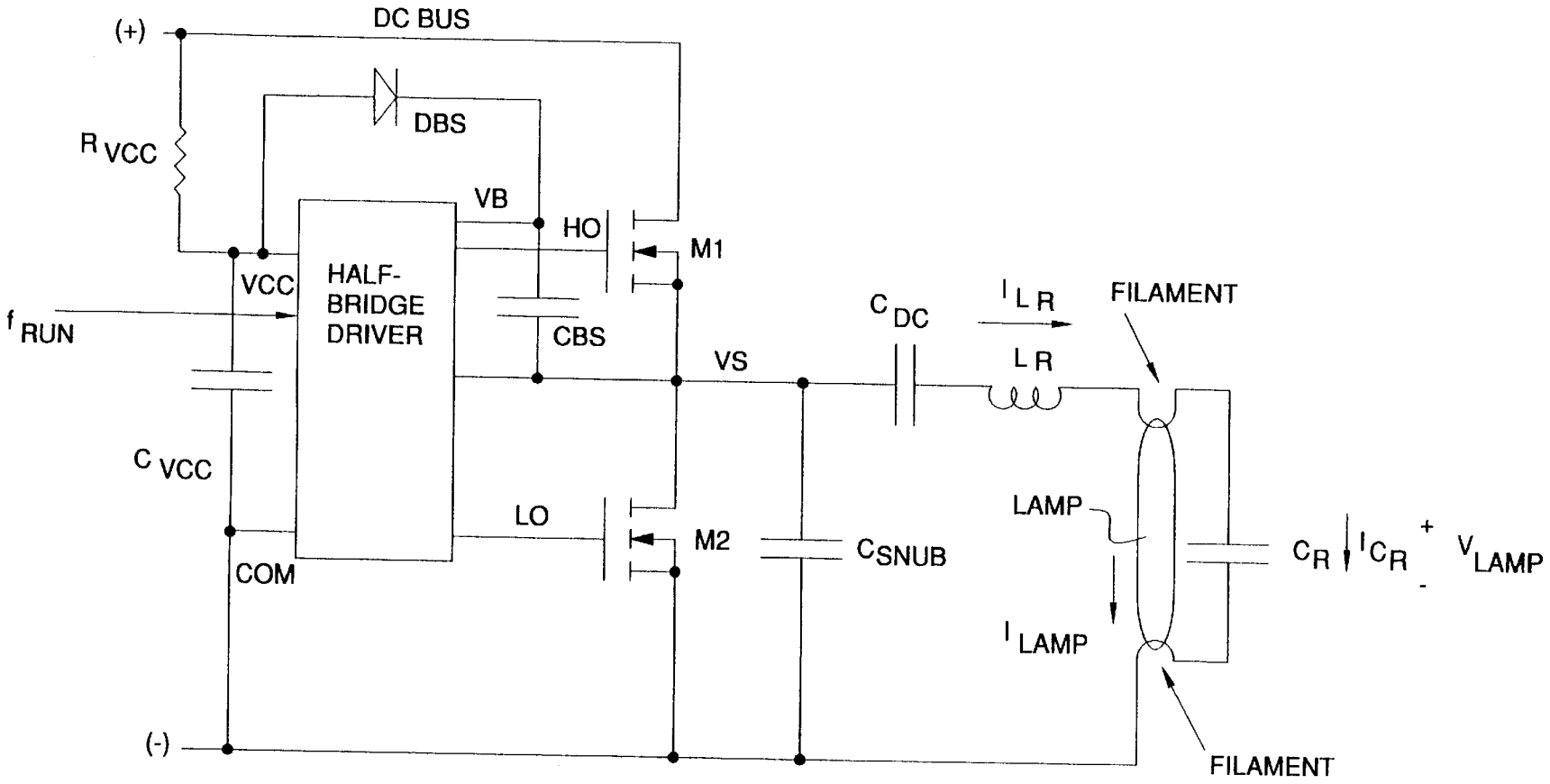
FIG. 1 PRIOR ART
FIG. 1 shows a typical prior art ballast output stage for a half-bridge driver circuit.
Figures 1, 2A:
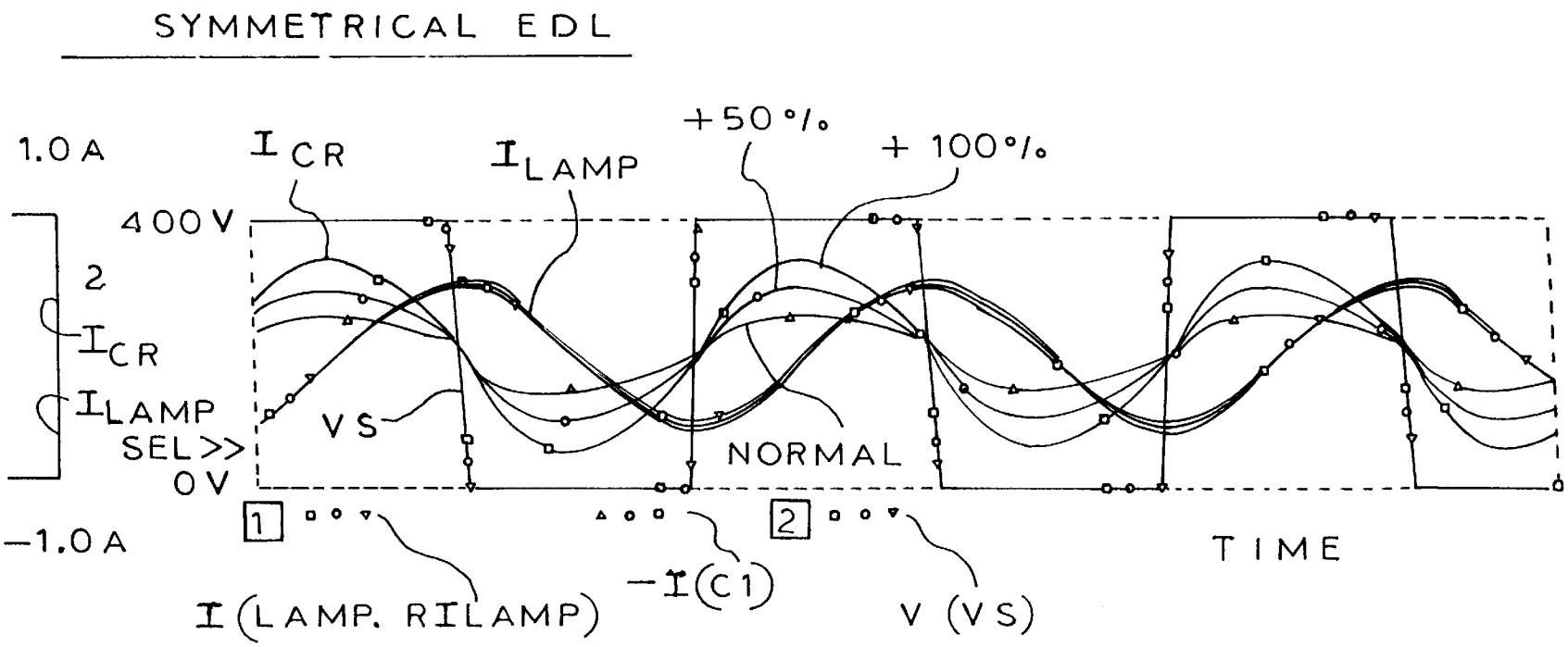
FIGS. 2*a*–2*d* are timing diagrams showing the typical running voltages and currents corresponding to the ballast output stage for both normal and end-of-life (symmetrical and asymmetrical) operating conditions.
Figures 2, 2A:
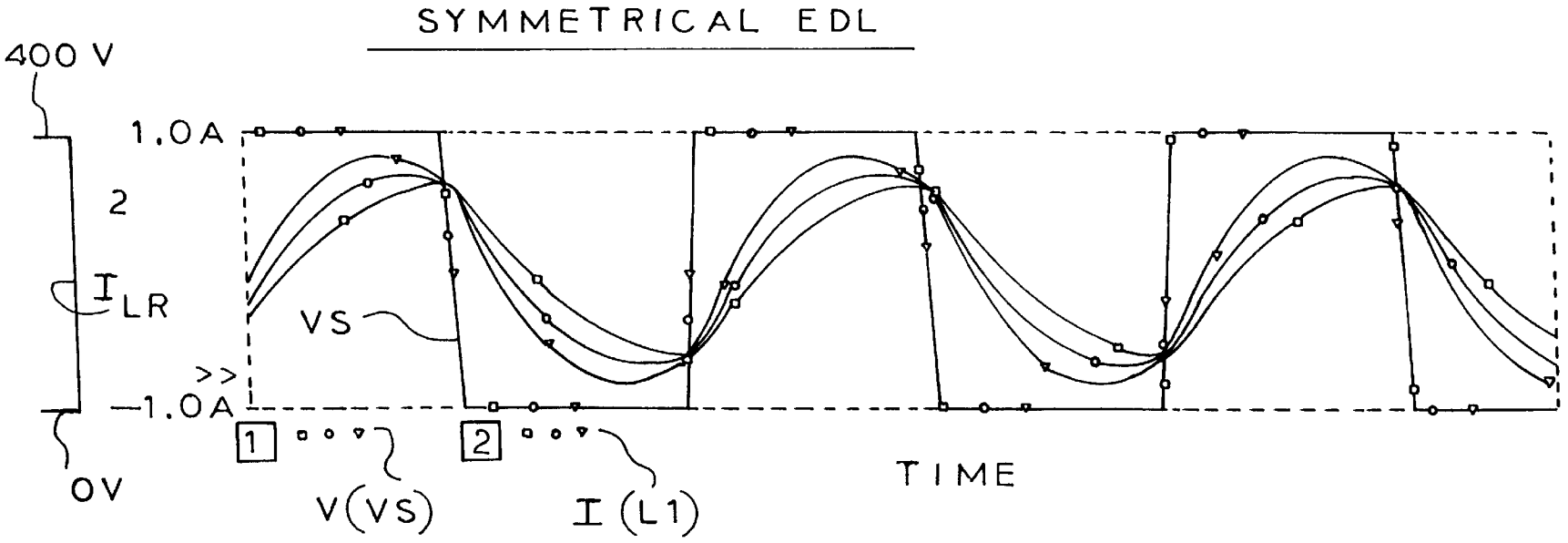
Figures 2, 2A, 3:
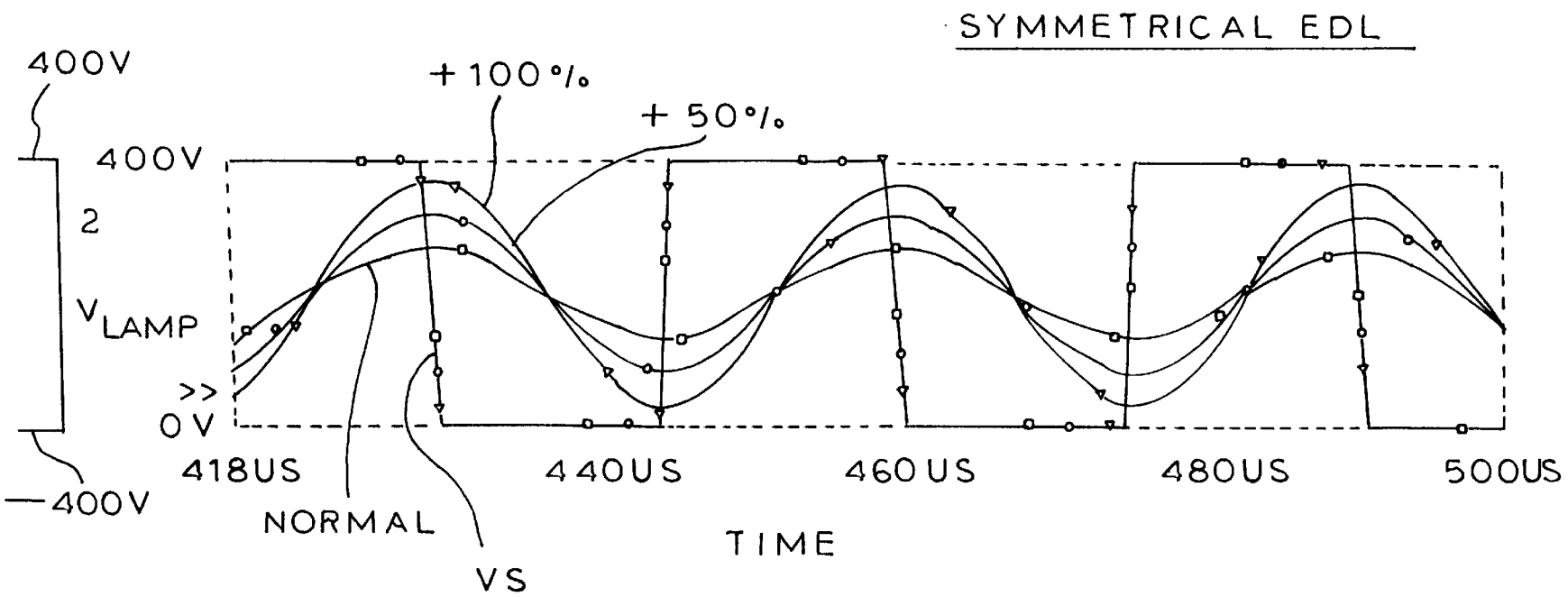
FIG. 3 shows a typical prior art end-of-life detection circuit.
Figures 1, 2B:
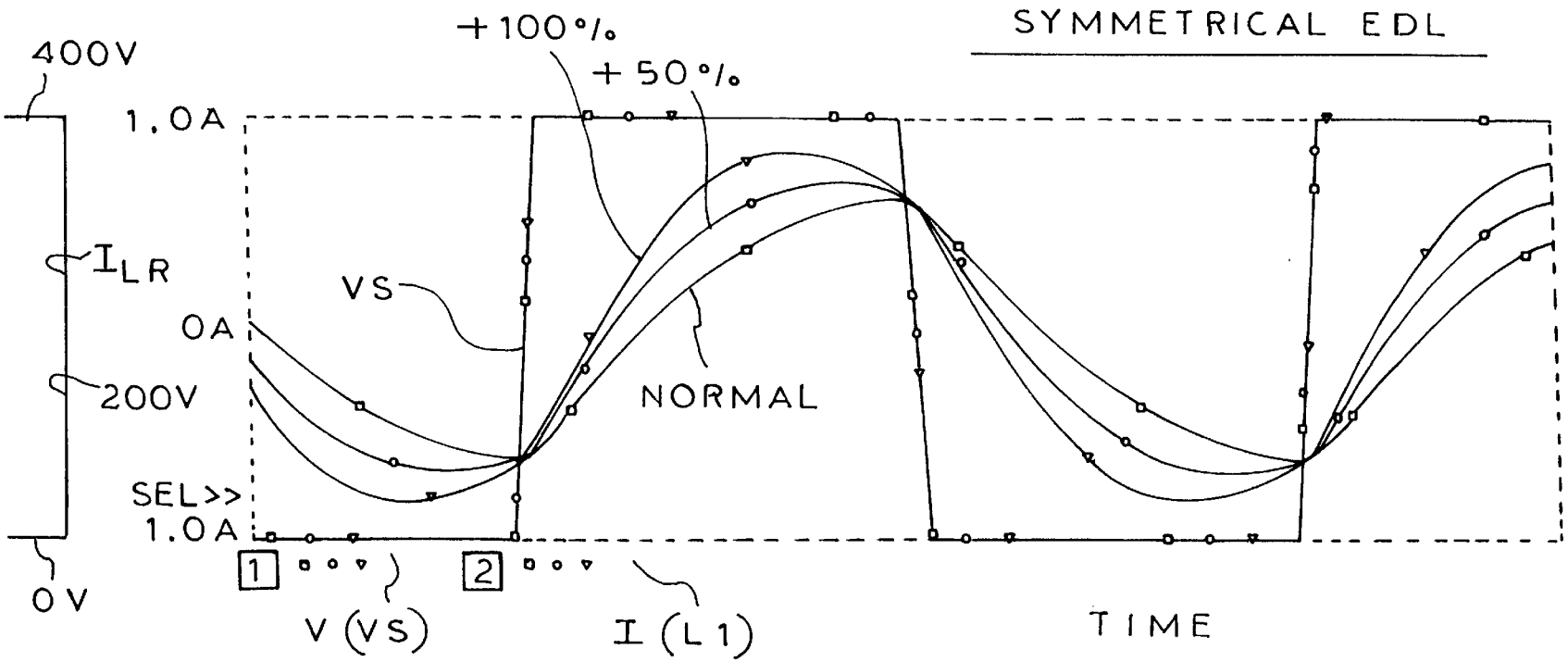
Figures 2, 2B:
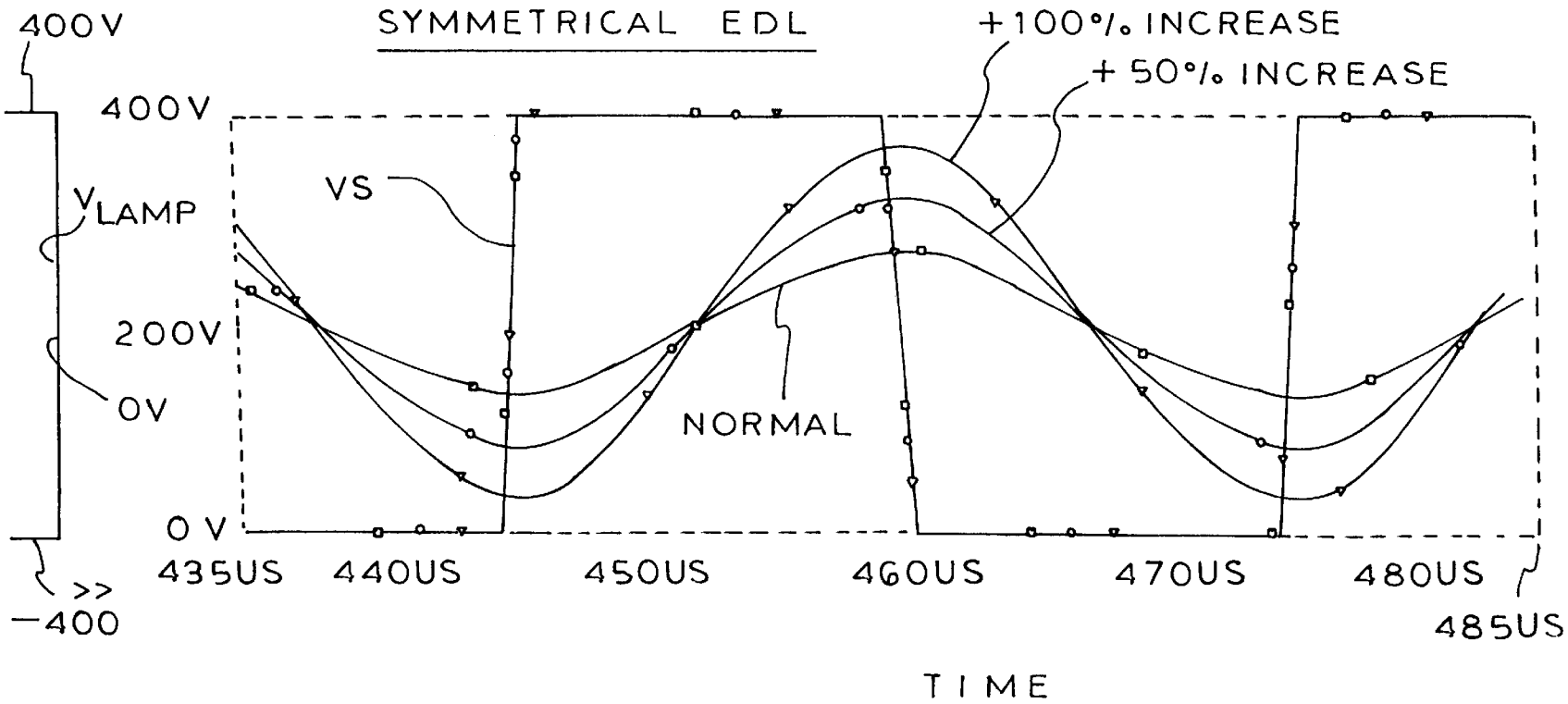
Figures 1, 2C:
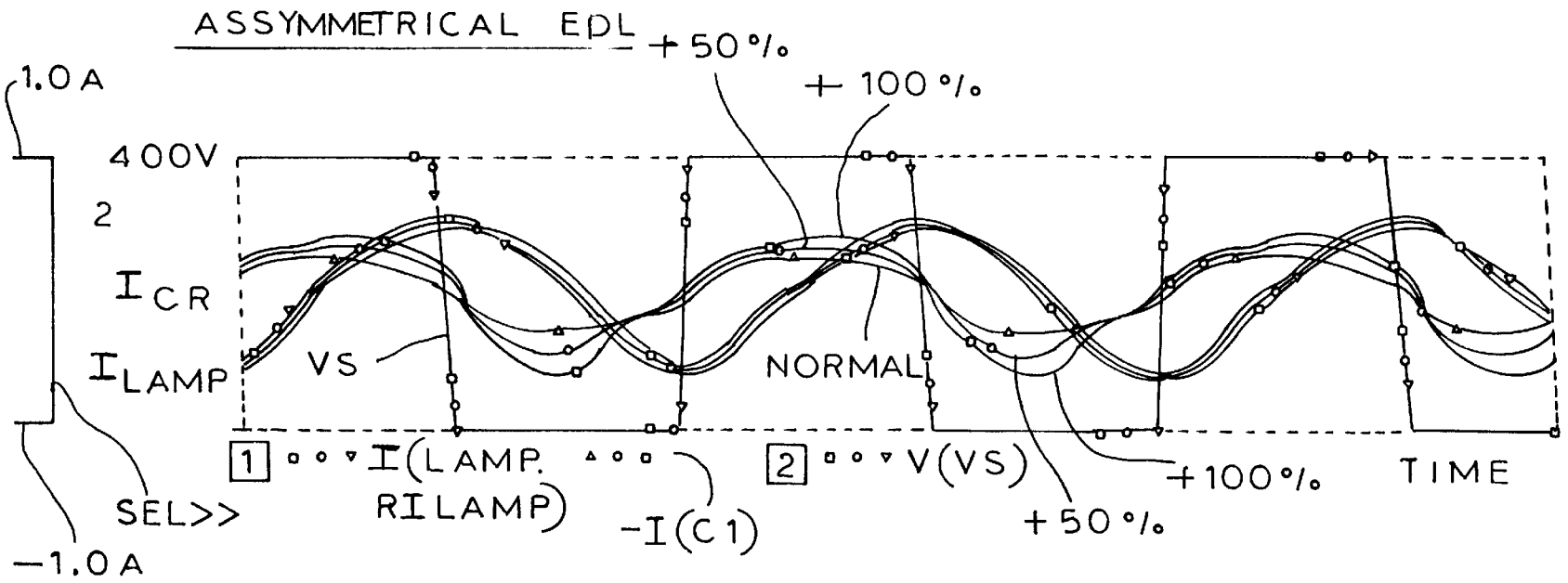
Figures 2, 2C:
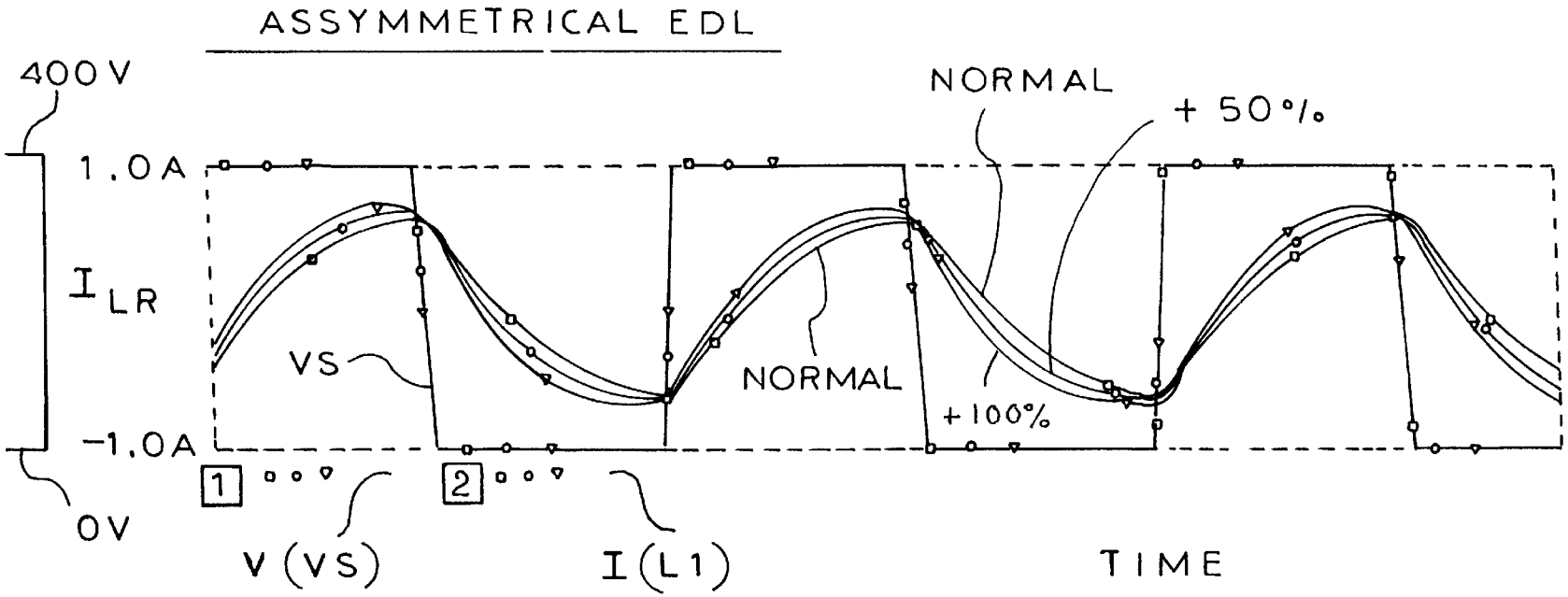
Figures 2, 2C, 3:
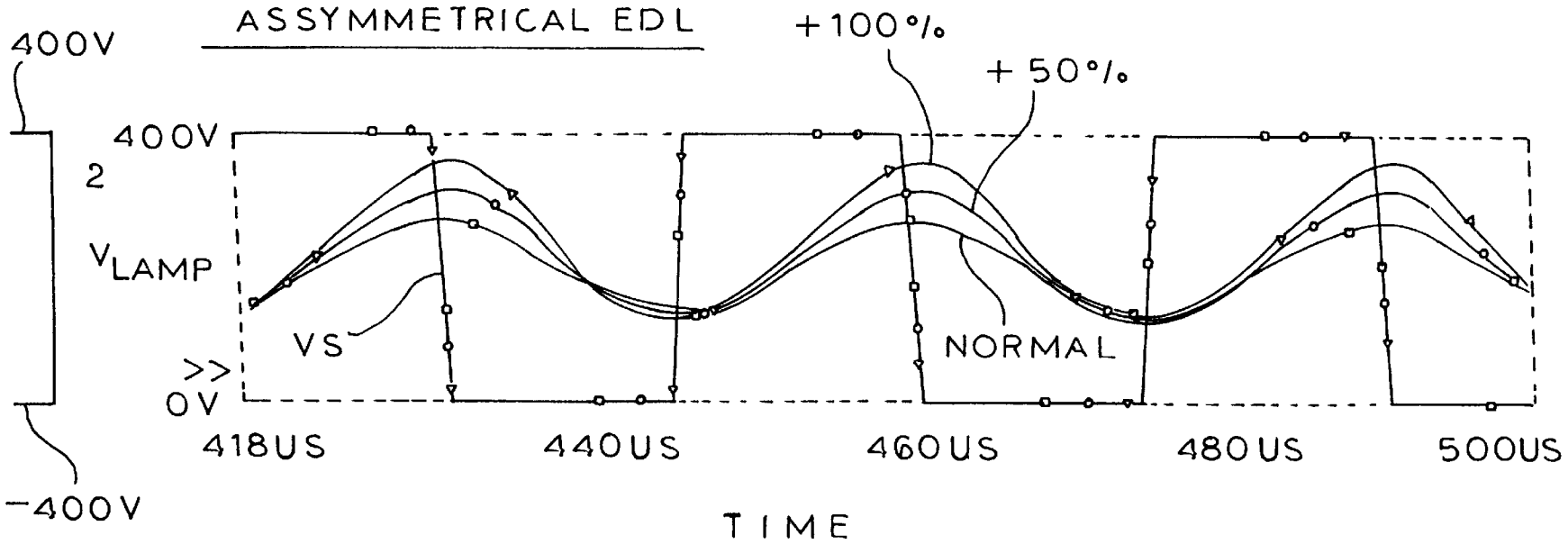
Figures 1, 2D:
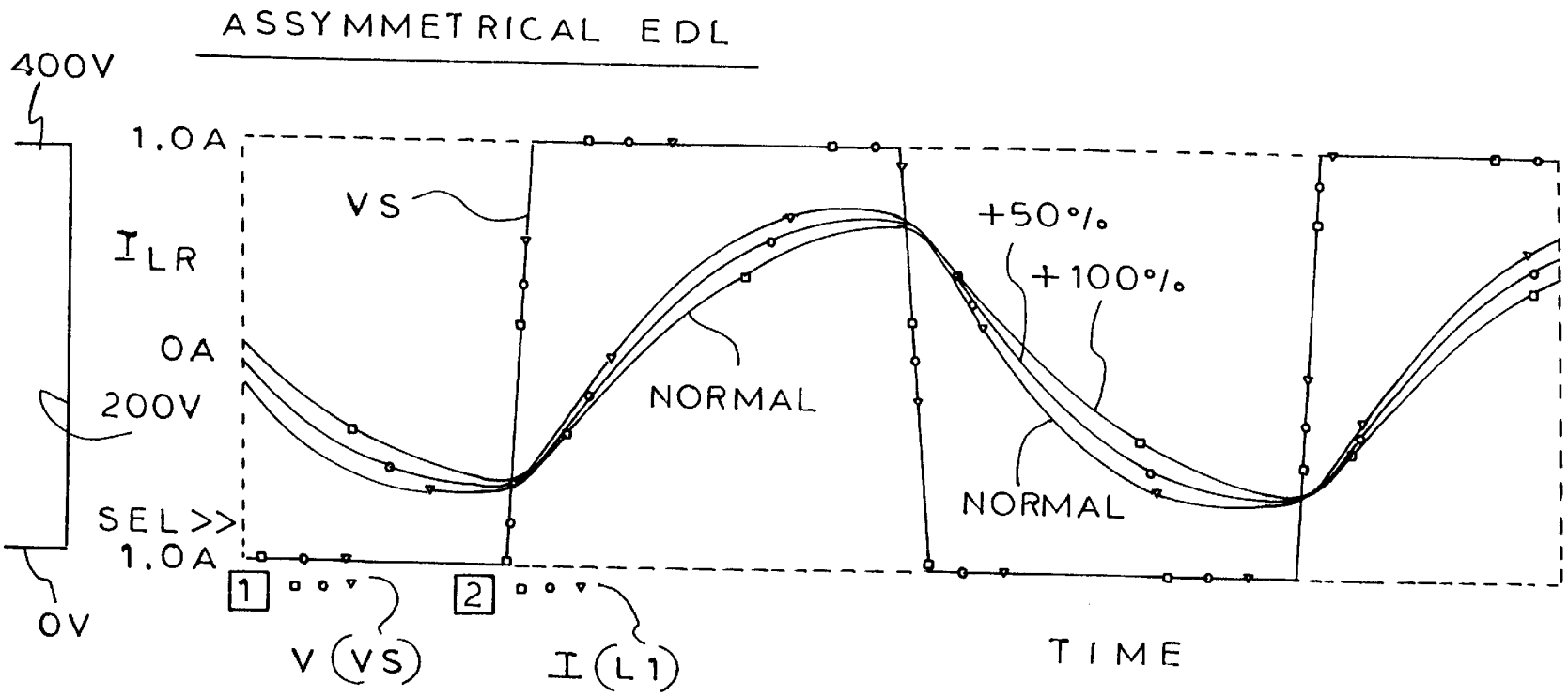
Figures 2, 2D:
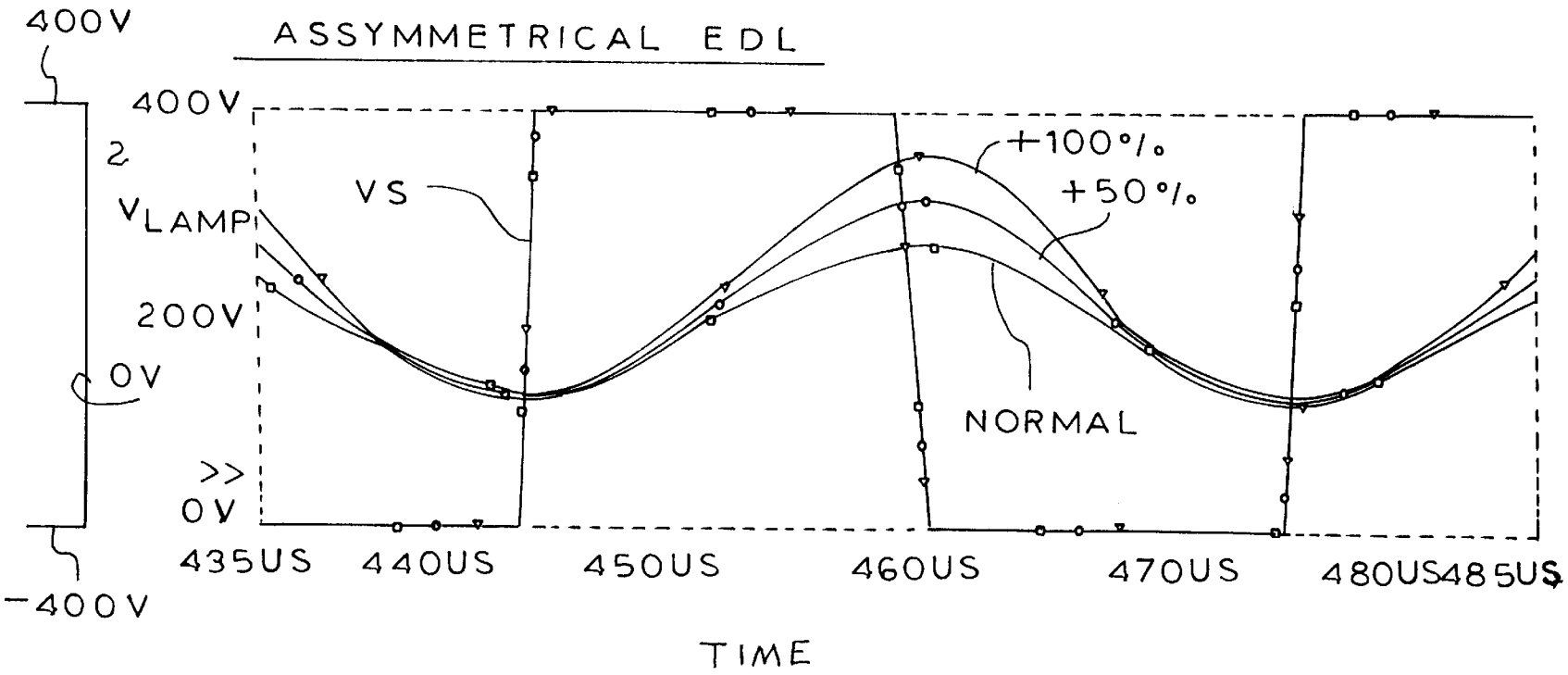
Figure 3:
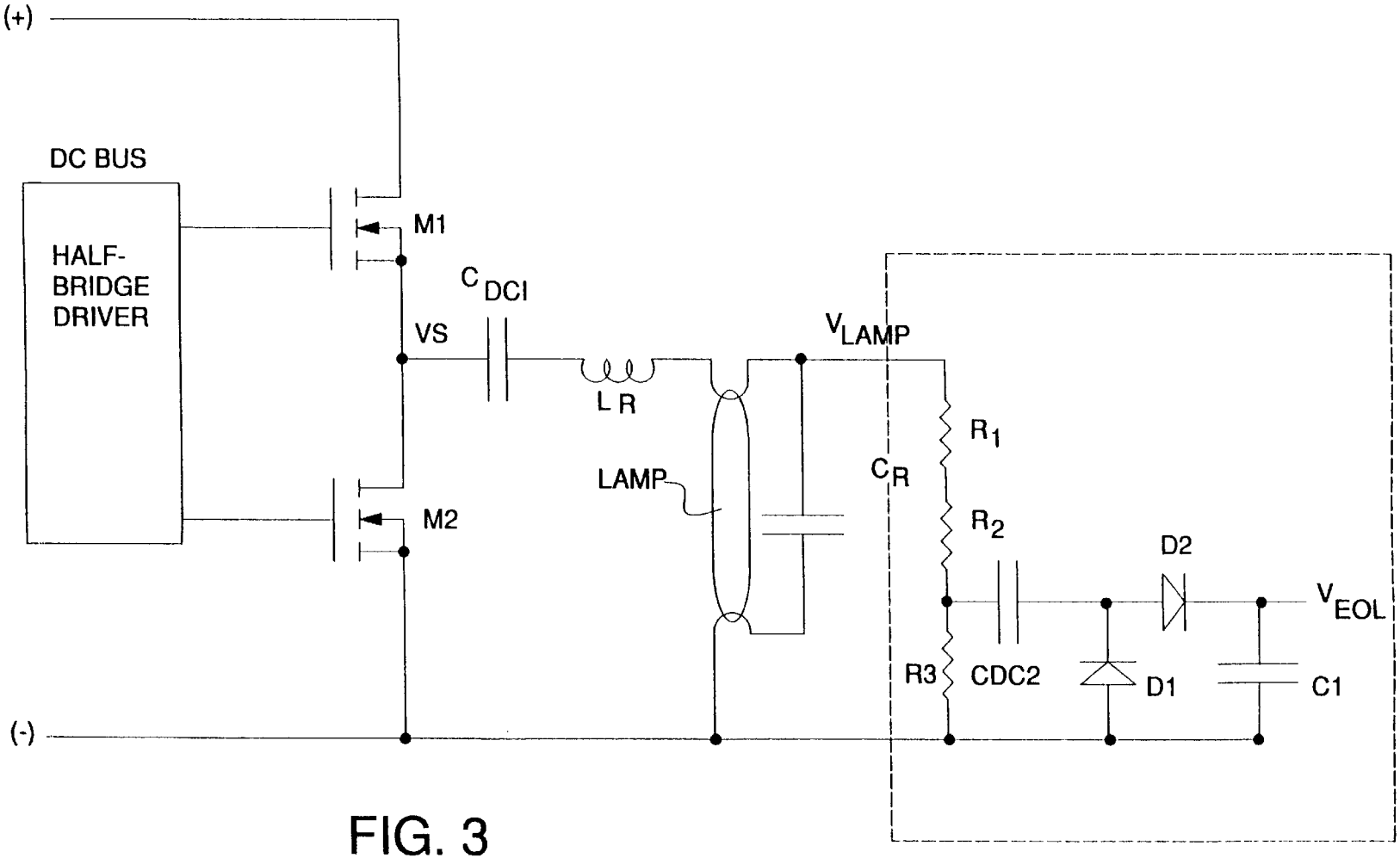
FIG. 3 PRIOR ART
Figure 4:
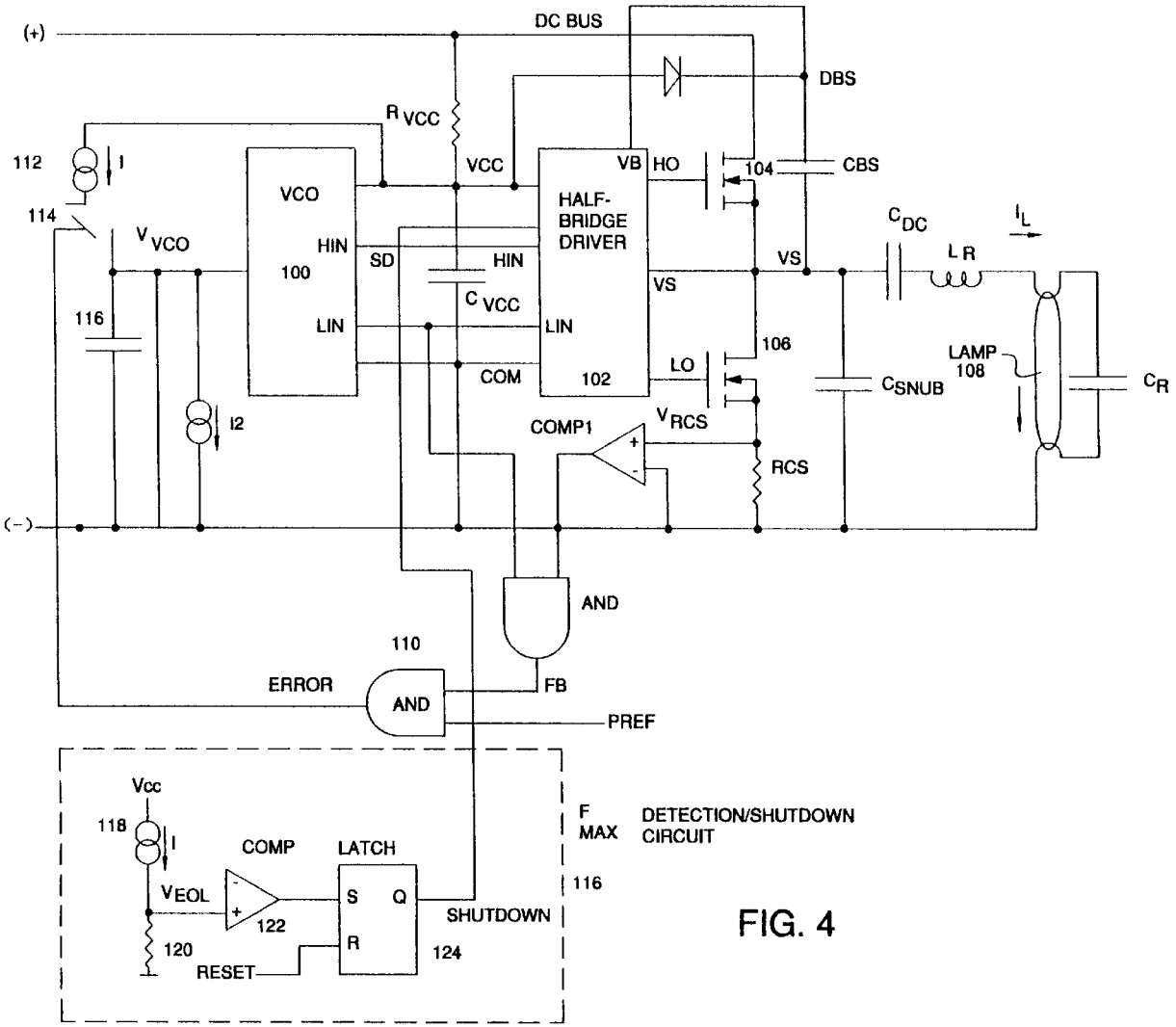
FIG. 4 shows the end-of-:Life/false lamp detection circuit of the present invention.

Referring to the circuit schematic shown in FIG. 4, in the circuit of the present invention, a voltage controlled oscillator, VCO 100, supplies input signals HIN and LIN to a half-bridge driver IC 102 which in turn produces appropriately timed, alternating square wave gate signals to drive upper arid lower power MOSFETs or IGBTs, 104 and 106, respectively, for powering a fluorescent lamp 108 of a typical lamp resonant circuit.

The circuit of the present invention includes a resistor $R_{CS}$ disposed between the lower MOSFET 106 and ground for generating a voltage $V_{CS}$ indicative of the phase FB of the lamp resonant circuit current. An AND gate 110 is provided to compare phase FB against a reference phase PREF. When the two signals are both high, the input voltage to VCO 100 is increased by switching in a current source 112 via switch 114 to charge capacitor 116. The circuit of the present invention thus regulates the load power (i.e., the power to lamp 108) using phase control. Phase control is used in the present invention to keep the load power constant by adjusting the operating frequency until the phase of the total load current (FB) is locked to a reference phase (PREF). Since the phase of the total load current is representative of the total load power, the power is therefore regulated against a reference power corresponding to the phase angle of the reference phase.

The $F_{MAX}$ detection/shutdown circuitry shown in the bottom portion of FIG. 4. identified generally by reference numeral 116 and comprising a current source 118 a resistor 120, comparator 122 and an R-S latch 124, monitors the voltage at the input to VCO 100 ($V_{VCO}$), which voltage is representative of the operating frequency, to detect an end-of-life or false lamp condition.

During normal operation, the voltage at the input of the VCO ($V_{VCO}$) will be relatively constant and somewhere between 0 and 5 volts (VCO range). Only small changes in this voltage will occur as the phase is "nudged" every few cycles to keep it locked against the reference.

A user programmable voltage ($V_{EOL}$) determined by current source 118 and the value of resistor 120, is continuously compared against $V_{VCO}$. If the voltage at the input VCO 100 ($V_{VCO}$) exceeds $V_{EOL}$, or, rather, if the operating frequency exceeds $F_{MAX}$, or, rather, if the load power exceed a $P_{MAX}$, the ballast is shut down. As the load power increases due to end-of-life or a wrong lamp type being driven, the phase control increases the operating frequency to keep the power constant. This continues until the user programmable setting (current source 118 through resistor 120 is exceeded ($V_{EOL}$) and the half-bridge is disabled via latch 124.

Figure 5:
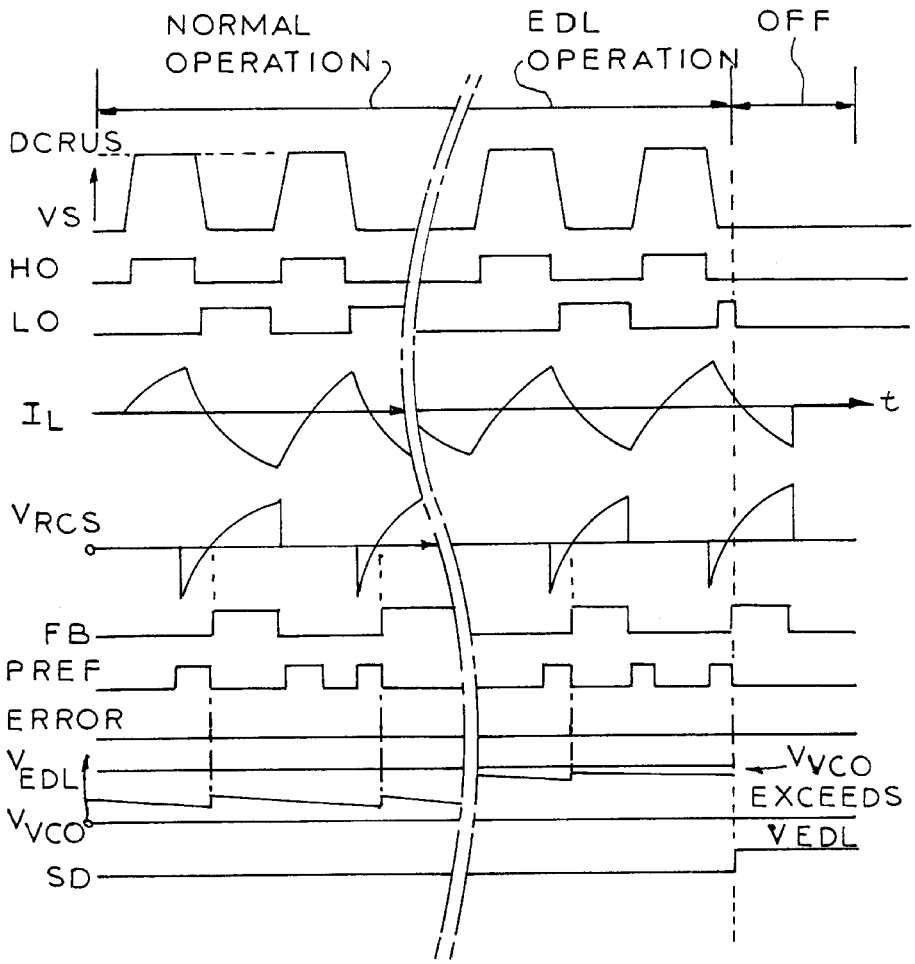
FIG. 5 are timing diagrams for the detection circuit of the present invention showing normal and end-of-life/false lamp operation.

FIG. 5 is a timing diagram which shows the circuit waveforms for the present invention during normal and end-of-life/false lamp operation.

In summary, the circuit of the present invention includes the following key features:

1) The circuit detects an end-of-lamp life condition by indirectly sensing total load power through an analog signal indicative of the operating frequency while controlling lamp power using phase control, and deactivates the half-bridge should the operating frequency exceed an $f_{max}$.

2) The circuit detects a false lamp being driven by a ballast which has been designed for a different lamp type consisting of a different nominal lamp power and/or voltage using the same technique described in 1), namely detecting by sensing the total load power through an analog signal indicative of operating frequency while controlling lamp power through phase control.

3) The circuit controls lamp power via phase control which enables the simple detection of excessive lamp power due to either a symmetrical or an asymmetrical increase in lamp running voltage over the course of the life of the lamp.

4) The circuit includes a simple resistor user-programmable interface which allows flexibility for setting different threshold levels for different ballast/lamp combinations.

5) The circuit is easily implemented in an electronic ballast driver IC (e.g., the IR2158/2159), resulting in the elimination of existing high-voltage-sensing-component methods, reduction of PCB interconnects, and an increase in manufacturability.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A circuit for controlling a fluorescent lamp driven by an electronic ballast driver circuit, the circuit comprising:

a lamp resonant circuit driven by the electronic ballast driver circuit at an operating frequency to generate a lamp resonant circuit current, said lamp resonant circuit current having a phase;

means for controlling lamp power using phase control by comparing the phase of the lamp resonant circuit current to a reference phase and adjusting the operating frequency of the driver circuit to maintain the phase of the lamp resonant circuit current equal to the reference phase;

means for indirectly sensing said lamp power through an analog signal indicative of the operating frequency of the driver circuit; and means for deactivating the driver circuit if the operating frequency of the driver circuit exceeds a predetermined maximum value.

2. A method for controlling a fluorescent lamp driven by an electronic ballast driver circuit at an operating frequency that generates a current in a lamp resonant circuit, the method comprising the steps of:

controlling lamp power using phase control by comparing a phase of the lamp resonant circuit current to a reference phase and adjusting the operating frequency of the driver circuit to maintain the phase of the lamp resonant circuit current equal to the reference phase;

indirectly sensing said lamp power through an analog signal indicative of the operating frequency of the driver circuit; and deactivating the driver circuit if the operating frequency exceeds a predetermined maximum value.

3. The circuit of claim 1, wherein the operating frequency of the driver circuit is adjusted based upon an error signal representative of the difference between the phase of the lamp resonant circuit current and the reference phase.

4. The circuit of claim 1, wherein the operating frequency of the driver circuit is generated by a voltage controlled oscillator that supplies input signals to a half bridge driver circuit for driving a pair of transistor switches disposed in a half bridge arrangement having a high side switch and a low side switch.

5. The circuit of claim 4, wherein the phase of the lamp resonant circuit current is detected by measuring a voltage across a resistor disposed between the low side switch and ground.

6. The circuit of claim 5, wherein the voltage across the resistor is compared to a low side potential to generate a signal representative of the phase of the lamp resonant circuit current.

7. The circuit of claim 4, wherein the means for shutting down comprises:

a comparator for comparing an input voltage of the voltage controlled oscillator to a reference voltage; and a latch for deactivating the driver circuit if the input voltage of the voltage controlled oscillator exceeds a predetermined amount.

8. The method of claim 2, wherein the operating frequency of the driver circuit is adjusted based upon an error signal representative of a difference between the phase of the lamp resonant circuit current and a reference phase.

9. The method of claim 2, wherein the operating frequency of the driver circuit is generated by a voltage controlled oscillator that supplies input signals to a half bridge driver circuit for driving a pair of transistor switches disposed in a half bridge arrangement having a high side switch and a low side switch.

10. The method of claim 9, wherein the phase of the lamp resonant circuit current is detected by measuring a voltage across a resistor disposed between the low side switch and ground.

11. The method of claim 10, wherein the voltage across the resistor is compared to a low side potential to generate a signal representative of the phase of the lamp resonant circuit current.

12. The method of claim 9, wherein the step of deactivating the driver circuit comprises the step of comparing the input voltage of the voltage controlled oscillator to a reference, and the driver circuit is deactivated if the voltage of the input of the voltage controlled oscillator exceeds a predetermined amount.

* * * * *